US006916356B2

(12) United States Patent
Margaria

(10) Patent No.: US 6,916,356 B2
(45) Date of Patent: Jul. 12, 2005

(54) METHOD FOR PREPARING ALUMINUM-SILICON ALLOYS

(75) Inventor: Thomas Margaria, Passy (FR)

(73) Assignee: Invensil, Chambery (FR)

( * ) Notice: Subject to any disclaimer, the term of this patent is extended or adjusted under 35 U.S.C. 154(b) by 148 days.

(21) Appl. No.: 10/380,769

(22) PCT Filed: Sep. 27, 2001

(86) PCT No.: PCT/FR01/02993

§ 371 (c)(1),
(2), (4) Date: Apr. 28, 2003

(87) PCT Pub. No.: WO02/29126

PCT Pub. Date: Apr. 11, 2002

(65) Prior Publication Data

US 2004/0035250 A1 Feb. 26, 2004

(30) Foreign Application Priority Data

Oct. 2, 2000 (FR) ..... 00 12508

(51) Int. Cl.[7] ..... C22C 21/02
(52) U.S. Cl. ..... 75/684; 420/548; 420/590

(58) Field of Search ..... 75/684; 420/548, 420/590

(56) References Cited

U.S. PATENT DOCUMENTS 5,069,875 A * 12/1991 Ohyama et al. ..... 420/548
5,782,955 A * 7/1998 Sales et al. ..... 75/255

FOREIGN PATENT DOCUMENTS

| | | |
|---|---|---|
| EP | 283517 | 9/1988 |
| EP | 423912 | 4/1991 |
| GB | 1463933 | 2/1977 |

* cited by examiner

*Primary Examiner*—Melvyn Andrews
(74) *Attorney, Agent, or Firm*—Dennison, Schultz, Dougherty & MacDonald

(57) ABSTRACT

A method for preparing Al—Si alloys by introducing into the molten aluminum, at a temperature of between 700 and 850° C., metallurgical silicon particles having a granulometry of less than 10 mm. The silicon particles, upon reaching the temperature of the molten aluminum, have the property of fragmenting into smaller particles.

7 Claims, No Drawings

METHOD FOR PREPARING ALUMINUM-SILICON ALLOYS

FIELD OF THE INVENTION

The invention relates to a method for preparing aluminum-silicon alloys, more particularly alloys with more than 7% silicon, by introduction of metallurgical silicon into the molten aluminum.

DESCRIPTION OF RELATED ART

Silicon is an additive element that is quite routine in aluminum alloys, especially in Al—Si—Mg (6000 series) alloys and Al—Si (4000 series) alloys. In this latter category of alloys used principally for manufacturing molded parts, the silicon content can be considerable and sometimes exceed the content of eutectic, which is around 13%. These alloys may contain other additive elements such as magnesium, copper, manganese, zinc or nickel.

Preparation of these alloys is generally done in a furnace or in an induction furnace at temperatures in the range of 700 to 800° C. At the start of the operation a charge of metallurgical silicon corresponding to approximately 75 to 90% of the necessary quantity is added to the aluminum charge. A this stage the silicon is charged in particles and its dissolution in the aluminum occurs progressively in the course of the fusion of the charge, which does not represent any delay whatsoever in the productivity of the furnace. Once the charge has melted, a sample is taken for analysis and complementary silicon is added to bring it to its final level and it is this operation, whose duration, conditioned by the kinetics of dissolution of the silicon into the alloy whose greater part is aluminum, is of such a nature as to limit the productivity of the furnace in which the operation is being carried out.

In the method practiced to date, this final addition is done in the form of silicon obtained from ingots whose mass is always greater than 10 kg, crushed and then ground in order to obtain pieces of less than 10 mm and, after screening to 1 mm, a product of size fraction of 1–10 mm.

The dissolution kinetics of solid silicon in aluminum and its alloys is relatively slow and notwithstanding the granulometry of introduction chosen for the silicon, the operation can easily take an hour. The bath stirring, for example with a scraper blade, is a general practices for accelerating dissolution of the additive elements such as silicon. It has the major drawback of destroying, each time it is used, the protective layer of aluminum that forms at the surface of the molten aluminum-based alloy and consequently resulting in aluminum losses of the order of 2 to 3% of the metal charge.

The difference in density between solid silicon and molten aluminum alloy in process of preparation is very low, such that the silicon introduced has a tendency to float at the surface of the alloy bath. The surface exposed to the atmosphere of the furnace is increased, which has the effect of increasing oxidation of the charged metallic elements and the formation of slag or dross prejudicial to yields.

SUMMARY OF THE INVENTION

The purpose of the invention is to provide a method for preparing Al—Si alloys, in particular alloys containing between 7 and 13% silicon, in the furnace or induction furnace, allowing rapid dissolution of the silicon, a reduction in the number of bath stirrings and reduced slag formation.

The object of the invention is a method for preparing Al—Si alloys by introducing into the molten aluminum, at a temperature in the range of 700 to 800° C., particles of metallurgical silicon having a granulometry of less than 10 mm, in which the silicon particles, when they reach the temperature of the molten aluminum, have the property of fragmenting into smaller particles.

Preferably, the metallurgical silicon particles used are prepared by water granulation of silicon on melting

DETAILED DESCRIPTION OF THE INVENTION

The invention is based on the finding made by the applicant of a different behavior at the time of preparing aluminum-silicon alloys, between the silicon routinely used and obtained by casting ingots, crushing and grinding, and the silicon so obtained by water granulation. This latter, under certain conditions of utilization, in fact allows reduction of both the duration of dissolution of the silicon in the molten aluminum and losses of metal due to oxidation.

Water granulated metallurgical silicon is used for the synthesis of halogenosilanes with are used in the preparation of silicones, as disclosed in the patents EP 0610807 (Wacker Chemie) or EP 0673880 (Pechiney Electrométallurgie). A water granulation method for silicon is described, for example, in patent FR 2723325 (Pechiney Electrométallurgie).

The applicant has attempted to analyze the differences between these two types of silicon particles. A first difference relates to the fine particle content. It is noted that in fact the presence in silicon crushed into granules, not insignificant quantities of particles of a size less than 5 μm. Experience shows that screening of a powder in order to extract from it the fraction smaller than 50 μm is almost ineffectual for eliminating the finer particles such as the fraction less than 5 μm, for example. These very fine particles are probably generated at the time of packaging the product and the observation of the powder under the microscope confirms their existence. The evaluation of their relative mass quantity can be determined by laser granulometry. Mass fractions of particles of a size less than 5 μm of the order of at least 0.5% are always found in the 1–10 mm size fraction of silicon produced by dry methods.

In water granulated silicon, on the other hand, advantage can be made of this method of preparing the product to insinuate into the process a rinsing step with water that makes it possible to eliminate the major part of the particles of a size of less than 5 μm. A granulate can thus be obtained that contains less than 0.1% of particles of a size of less than 5 μm; that is, even less that 0.05% by doing two rinses in succession. It is also interesting to note that in the product prepared in this fashion, the rates of particles smaller than 50 μm and 5 μm, respectively, remains practically unchanged after its ultimate increase to the temperature of the molten metal.

One other difference has been shown at the time of introduction trials into the molten aluminum done in the laboratory by the applicant. In fact, these trials have shown a particular behavior of water granulated silicon relative to crushed silicon. Placed at the surface of the aluminum bath in melting, the grains explode suddenly and break into smaller particles that are projected several tens of centimeters. It is conceivable that this behavior would be the consequence of traces of residual humidity. In order to elucidate this point, the application conducted tests in a laboratory furnace heated to between 700° C. and 850° C., but empty, and thus without aluminum in melting. The behavior of the granulated silicon introduced into this furnace under these conditions was the same as that in the presence of aluminum, which excludes the explanation of a reaction between the aluminum and any traces of humidity.

The bursting of the particles affects not merely a few particles of granulated silicon but the majority of them, which excludes the explanation of an abrupt volatilizaton of incidental water inclusions present in some of the particles.

The bursting of the largest particles remains relatively superficial and leaves relatively mechanically stable nuggets. On the other hand, for the particles of a size of less than 10 mm, each particle fragments producing but 2 to 4 particles. The product obtained is absent of fines both smaller than 50 μm and less than 5 μm. Thus, when the test is done on a sample of particles of a size in the range of between 5 and 6.7 mm, the following composition is found after thermal treatment, expressed in number of particles:

particles of a size greater than 5 mm: 37% particles of a size between 2 and 5 mm: 47% particles of a size between 1.6 and 2 mm: 7%.

The cause of this behavior of granulated silicon should probably be sought in the internal mechanical stresses accumulated in the metal at the time of rapid solidification and which are released at the time of thermal shock provoked by their introduction into the molten aluminum.

For particle sizes greater than 10 mm, the phenomenon is less marked and the behavior of the granules obtained by reconditioning and crushing of the larger particles leaving water granulation tends to confuse with that of silicon cast into ingots, crushed and ground. This behavior may be due to the poor thermal conduction of silicon, which has the consequence, at the time of water granulation, of limiting the chill effect at the envelope of the particles, while the interior temperature lowers only very slowly.

As water granulation of molten silicon can produce products whose granulometry is between 0 and 30 mm, it is necessary to choose using granulated silicon, for example by screening, a finer fraction size, with the limitation to the fraction of less than 10 mm.

In order to obtain a satisfactory yield of silicon at the time of introduction into the molten aluminum, it is necessary to respect certain operating conditions. The difference in density between the solid granulated silicon and molten aluminum being very small, the granulated silicon, like crushed silicon, has a tendency to float at the surface of the bath and can be found preferentially in the slag. Therefore, it is necessary to properly deslag the surface of the fusion bath prior to adding the granulated silicon. In addition, it is preferable to work at a temperature in the range of 800° C. and 850° C. or around 50° C. at least above the temperature considered in current operating conditions.

Under these conditions, it can be confirmed:

that the dissolution kinetics of granulated silicon is more rapid that that of crushed silicon and remains so for comparable granulometry, the gain that makes it possible for granulated silicon over the speed of dissolution is more significant than that which allows an increase in temperature, without having the drawbacks in terms of oxidation of the bath.

that necessary raking of the bath in conjunction with a product that dissolves rapidly can be less frequent and less significant than with a product that dissolves only slowly.

Consequently, the duration of preparing the alloy and the number of rakings can be reduced, which makes it possible to significantly reduce losses due to oxidation. A 1% gain is confirmed regarding the metal yield in operations of the order of 100 kg; said gain can attain 3% in operations of 5 t.

The method according to the invention makes it possible to obtain Al—Si alloys of a quality at least as good as those prepared using crushed or ground silicon. The inclusion quality of the alloys is at the same level, the number of inclusions detected in the alloy do not vary significantly. The hydrogen contents measured on the molten alloy are of the order of 0.1 to 0.2 $cm^3$ of hydrogen for 100 g of alloy. At the time of adding the silicon, these contents vary more or less 10% whatever the type of silicon used, which confirms that granulated silicon does not make a significant hydrogen contribution.

EXAMPLES

In the examples that follow, control of inclusion quality of the molten metal was done using K-Mold tests and LIMCA (liquid metal cleanliness analysis), whose purpose it is to quantify the concentrations of oxide inclusions using the results expressed in the units proper to each of these tests.

The K-Mold test consists of counting the number of inclusions found on the fracture surface of a test piece cast in a mold of defined shape. The results are expressed in the number of inclusions at the fracture surface of the test piece. This test allows detection of gross inclusions, typically in the range of 50 μm–300 μm.

LIMCA testing implements a piece of equipment related to the Coulter counter and makes possible evaluation of the concentration in the metal of solid inclusions of a size between 20 μm and 150 μm; the results are expressed in the number of inclusion per kg of metal. For Al—Si alloys the values observed can range from 1,000 inclusions per kg for an alloy considered clean to 100,000 inclusions per kg for a very dirty alloy.

Control of the hydrogen content is done with the aid of an ALSCAN apparatus that allows direct measurement of the hydrogen content in the molten alloy. The results are expressed in $cm^3$ of hydrogen gas at normal conditions of temperature and pressure for 100 g of alloy.

Example 1

Production in a silicon furnace, processed in a ladle in order to eliminate principally calcium, was cast in ingots in an ingot melt process of approximately 10 cm in thickness. Analysis of the metal revealed:

Fe, 0.27%; Ca, 0.045%; Al, 0.12%; C, 0.08%

P, 12 ppm

Mn, 0.07%; Cr, 3 ppm; Cu, 1 ppm; Ti, 12 ppm;

Ni, 4 ppm; V, 8 ppm

This product was ground to a maximum particle size of 10 mm, then screened to 1 mm to separate the 1–10 mm fraction. In order to evaluate the quality of this product, a sample was taken and then washed in water.

The wash water was then evaporated to recover the fines that were analyzed using a laser granulometer. Thus, it was possible to reconstitute the actual granulometric analysis of the original product, which was confirmed to contain 0.51% of fines of a size less than 5 μm.

This classical silicon cast in ingots, crushed and then ground and screened to 1–10 mm was separated into four identical batches, one of which was used in the testing laboratory for a determination of the Al—Si alloy baths prior to casting. The operations carried out comprise increasing content of 1% in the silicon of Al—Si alloys to, respectively, 0, 6, and 12% of Si. These operations were carried out in an electrical resistance furnace at 750° C. using alloy smelting pots of 100 kg of alloy. The times necessary for dissolution of the silicon additive were measured at from 10 to 12 minutes.

The tests done on hydrogen measured on molten metal before and after the addition of silicon produced practically constant results in the area of 0.18 $cm^3$ /100 g. The metal yield was estimated at 98.3%.

Example 2

The second batch of ground silicon prepared in Example 1 was used in a laboratory test of the preparation of the A-S13 alloy for adjustment of the bath prior to casting. The operation was carried out in a 5-ton furnace, whose temperature was regulated using 750° C. as the setpoint. For calibration, 245 kg of product was added and between the moment of said addition and final casting, 37 elapsed. The bath was slagged off twice and at the end of the operation 16 kg of slag had been collected.

The calculated silicon yield pursuant the increase in titre following the addition was 93%.

Quality control of the AS13 alloy produced the following elements:

Inclusion quality evaluated using the LIMCA method: 1100 inclusions/kg.

Hydrogen content: 0.20 $cm^3$/100 g.

Example 3

The third batch of ground silicon prepared in Example 1 was used to repeat the experiment in Example 1 while controlling the temperature of the furnace at 810° C. The time necessary for dissolution of silicon additions were in the range of 8 to 10 minutes, which makes possible evaluation of about 20% gain due to the effect of the temperature rise.

The tests done on the metal before and after addition of the silicon showed a mean progression of the K-Mold index of approximately 15.

The hydrogen contents measured on the molten metal before and after addition of the silicon produced practically constant results in the area of 0.22 $cm^3$/100 g.

The metal yield was estimated at 96%.

Example 4

The fourth batch of ground silicon prepared in Example 1 was used in a laboratory test of the preparation of the A-S13 alloy for adjustment of the bath prior to casting. The operation was carried out in a 5-ton furnace, whose temperature was regulated using 810° C. as the setpoint. For calibration, 179 kg of product was added and between the moment of said addition and final casting, 28 elapsed. The bath was slagged off twice and at the end of the operation 12 kg of slag had been collected.

The calculated silicon yield pursuant the increase in titre following the addition was 94%.

Quality control of the AS13 alloy produced the following elements:

Inclusion quality evaluated using the LIMCA method: 1400 inclusions/kg.

Hydrogen content: 0.20 $cm^3$/100 g.

Example 5

A production test of granulated silicon was done using the same industrial installation as that which was used to prepare the ground silicon of Example 1 without changing the silicon furnace charge or the operational conditions of the ladle processing for refining. The contents of a ladle of molten silicon at 1530° C. were cast using a water granulation vat installation.

The product collected in the granulation vat was subjected to rinsing in a water spray prior to being dried and then screened to 10 mm. The fraction greater than 10 mm was removed and used in other applications. No 1 mm screening was done.

The 0/10 granulate obtained was subjected to granulometric inspection under the same conditions as in Example 1. The fines content of a size of less than 5 $\mu$m was 0.03%.

Chemical analysis of the metal produced the following results:

Fe, 0.28%; Ca, 0.038%; Al, 0.14%; C, 0.08%

P, 12 ppm

Mn, 0.07%; Cr, 3 ppm; Cu, 1 ppm; Ti, 14 ppm

Ni, 4 ppm; V, 7 ppm.

The metal prepared in this fashion was separated into two identical batches, one of which was used in the testing laboratory for adjustment of the Al—Si alloy baths prior to casting. As in Example 1, the operations carried out consisted of increasing by 1 point the silicon content of the Al—Si alloys to 0, 6, and 12%, respectively. These operations were carried out in a resistance furnace at 750° C. using 100 kg alloy pots.

The times required for dissolution of the silicon addition were in the range of 10 to 12 minutes.

The tests done on the metal before and after addition of the silicon showed a mean progression of the K-Mold index of approximately 12.

The hydrogen contents measured on the molten metal before and after addition of the silicon produced practically constant results in the area of 0.22 $cm^3$/100 g.

The metal yield was estimated t 99.0%.

Example 6

The second batch of granulated silicon was used in a laboratory test of the preparation of the A-S13 alloy for adjustment of the bath prior to casting. The operation was carried out in a 5-ton furnace, whose temperature was regulated using 810° C. as the setpoint. For calibration, 256 kg of product was added. Melting and mixing of this addition proceeded very rapidly; the bath was slagged off only once and casting was begun only 19 minutes after the addition of the silicon. At the end of the operation only 3.5 kg of slag had been collected.

The calculated silicon yield pursuant the increase in titre following the addition was 98%.

The silicon yield, calculated according to the increase in titre consequent to the addition was 98%.

Inclusion quality evaluated using the LIMCA method: 800 inclusions/kg.

Hydrogen content: 0.18 $cm^3$/100 g.

What is claimed is:

1. A method for preparing an Al—Si alloy, comprising introducing into molten aluminum, at a temperature of between 700 and 850° C., metallurgical, water granulated silicon particles having a granulometry of less than 10 mm, wherein the silicon particles fragment into smaller particles upon reaching the temperature of the molten aluminum.

2. The method according to claim 1, wherein the temperature of the introduction of the silicon particles is between 800 and 850° C.

3. The method according to claim 1, wherein the silicon particles introduced contain less than 0.1% of particles of a size less than 5 m$\mu$.

4. The method according to claim 3, wherein after fragmentation, the silicon particles comprise less than 0.1% of particles of a size less than 5 m$\mu$.

5. The method according to claim 1, wherein the silicon particles introduced contain less than 0.05% of particles of a size less than 5 m$\mu$.

6. The method according to claim 1, wherein the silicon particles are obtained by screening a 1–10 mm fraction size of water-granulated silicon, without subsequent crushing or grinding.

7. The method according to claim 6, wherein the water granulated silicon particles are subjected to at least one rinsing step with water in order to eliminate finer particles prior to final drying.

* * * * *